US010729239B2

(12) United States Patent
Murcinova

(10) Patent No.: US 10,729,239 B2
(45) Date of Patent: Aug. 4, 2020

(54) DEVICE FOR THE STORAGE, TRANSPORT AND APPLICATION OF COSMETICS

(71) Applicant: Monika Murcinova, Las Vegas, NV (US)

(72) Inventor: Monika Murcinova, Las Vegas, NV (US)

( * ) Notice: Subject to any disclaimer, the term of this patent is extended or adjusted under 35 U.S.C. 154(b) by 0 days.

(21) Appl. No.: 15/944,769

(22) Filed: Apr. 3, 2018

(65) Prior Publication Data

US 2018/0368571 A1 Dec. 27, 2018

Related U.S. Application Data

(60) Provisional application No. 62/604,090, filed on Jun. 23, 2017.

(51) Int. Cl.

| | |
|---|---|
| ***A47B 67/00*** | (2006.01) |
| ***A45D 44/00*** | (2006.01) |
| ***A47B 43/00*** | (2006.01) |
| ***A47B 45/00*** | (2006.01) |
| ***A45D 42/00*** | (2006.01) |
| ***A45C 11/00*** | (2006.01) |
| ***A45C 15/04*** | (2006.01) |

(52) U.S. Cl.

CPC ..... *A47B 67/005* (2013.01); *A45C 11/008* (2013.01); *A45C 15/04* (2013.01); *A45D 42/00* (2013.01); *A45D 44/00* (2013.01); *A47B 43/00* (2013.01); *A47B 45/00* (2013.01); *A45D 2200/25* (2013.01)

(58) Field of Classification Search

CPC ..... A47B 67/005; A47B 43/00; A47B 45/00; A45D 44/00

USPC ..... 312/227; 108/115–117, 131–133

See application file for complete search history.

(56) References Cited

U.S. PATENT DOCUMENTS

| | | | | | |
|---|---|---|---|---|---|
| 1,035,896 | A * | 8/1912 | Padley | A47B 3/00 | 108/116 |
| 1,495,046 | A * | 5/1924 | Spiegel | A45C 13/02 | 190/11 |
| 2,145,462 | A * | 1/1939 | Speck | A45C 15/04 | 132/288 |
| 2,202,318 | A * | 5/1940 | Ralson | A47B 3/0815 | 403/65 |
| 2,690,369 | A * | 9/1954 | Laskey | A47B 3/0818 | 403/65 |
| 2,695,112 | A * | 11/1954 | Bonnevay | A45C 13/02 | 132/315 |

(Continued)

*Primary Examiner* — Daniel J Troy
*Assistant Examiner* — Timothy M Ayres

(57) ABSTRACT

A device including a base section operable for storage or transport of cosmetic items; a compartmentalized storage area including at least one large storage area and at least one small storage area; a primary lid portion that is configured to provide cover for the base section; a mirror appliance disposed on an interior surface of the primary lid portion; a cushioned interior surface; a protective pad that is configured to prevent the stored cosmetic items from making contact with said mirror appliance during transport; a retractable support leg implement; and a chamber section, in which the chamber section comprises at least two open chamber sections being disposed on each side of a bottom portion of the base section, wherein each of the two open chamber sections are configured to house at least two retractable support leg implements.

16 Claims, 9 Drawing Sheets

(56) References Cited

U.S. PATENT DOCUMENTS 2,769,650 A * 11/1956 Larson ..... A47B 3/0818 403/61
3,123,022 A * 3/1964 Huddleston ..... A47B 3/0818 108/129
3,156,510 A * 11/1964 Hindin ..... A47B 67/005 108/125
3,381,782 A * 5/1968 Ikelheimer ..... A45C 13/02 190/110
3,421,679 A * 1/1969 Goldman ..... B65D 5/48038 108/161
3,547,054 A * 12/1970 Caldwell ..... A47B 3/0815 108/115
4,093,010 A * 6/1978 Hunley ..... A45C 11/38 206/316.2
4,106,597 A * 8/1978 Shook ..... A45C 11/20 190/110
4,372,630 A * 2/1983 Fuhri ..... A47B 97/08 206/1.7
4,461,332 A * 7/1984 Parkhurst ..... A45C 3/00 132/314
4,856,627 A * 8/1989 Polatov ..... A45C 9/00 190/11
6,533,410 B1 * 3/2003 Shefler ..... A45C 11/00 206/5
6,811,006 B1 * 11/2004 Mundle ..... A45C 13/02 190/1
7,503,267 B1 * 3/2009 Zemel ..... A47B 3/08 108/115
7,765,939 B2 * 8/2010 Chen ..... A47B 3/08 108/127
7,966,950 B2 * 6/2011 Volpe, Jr. ..... B60N 3/002 108/115
2014/0318570 A1 * 10/2014 Petry ..... A45C 5/005 132/314

* cited by examiner

DEVICE FOR THE STORAGE, TRANSPORT AND APPLICATION OF COSMETICS

CROSS-REFERENCE TO RELATED APPLICATIONS

The present Utility patent application claims priority benefit of the U.S. provisional application for patent Ser. No. 62/604,090, filed on Jun. 23, 17 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not Applicable

INCORPORATION BY REFERENCE OF SEQUENCE LISTING PROVIDED AS ATEXT FILE

Not Applicable

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to cosmetics kits and cases. More particularly, certain embodiments of the invention relate to a case for storage and application of cosmetic items.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Typical cosmetics kits include a palette containing a supply of variously colored shadow and tint materials, a powder material, one or more implements for applying the materials, and an openable case for the above. The term makeup, in the sense this term is used in connection with cosmetics, encompasses the full range of cosmetics employed by people to beautify and color their faces.

Included, therefore, in makeup are lipstick, blushes, mascara and eye shadow, as well as pressed facial powders. In some instances, cosmetics may be applied by a finger to the user's face and in others by brushes and other applicators.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that due to the large assortment of cosmetic makeup items available to a user, one may expect that these items may usually be deployed on a mirrored dressing table or stored in a cosmetic cabinet or on a bathroom countertop. But when away from home, the user will usually only take along in a purse or handbag the one or two cosmetic items she needs for a particular occasion to touch up her face to which she had already applied cosmetics. Thus, when attending a party, she may bring with her only a powder compact and a lipstick. Typical cosmetic vanities include a hollow, box-like case, one end of which is open to receive a sliding drawer containing various cosmetics and related implements. Attached to the exterior is a mirror that is always exposed regardless of whether the drawer is pushed in or pulled out. Hence the mirror remains unprotected even when the vanity is shut and is being transported. This mirror is not only subject to breakage, but it also tends to gather dirt on its surface.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF SOME EMBODIMENTS

Figure 1:
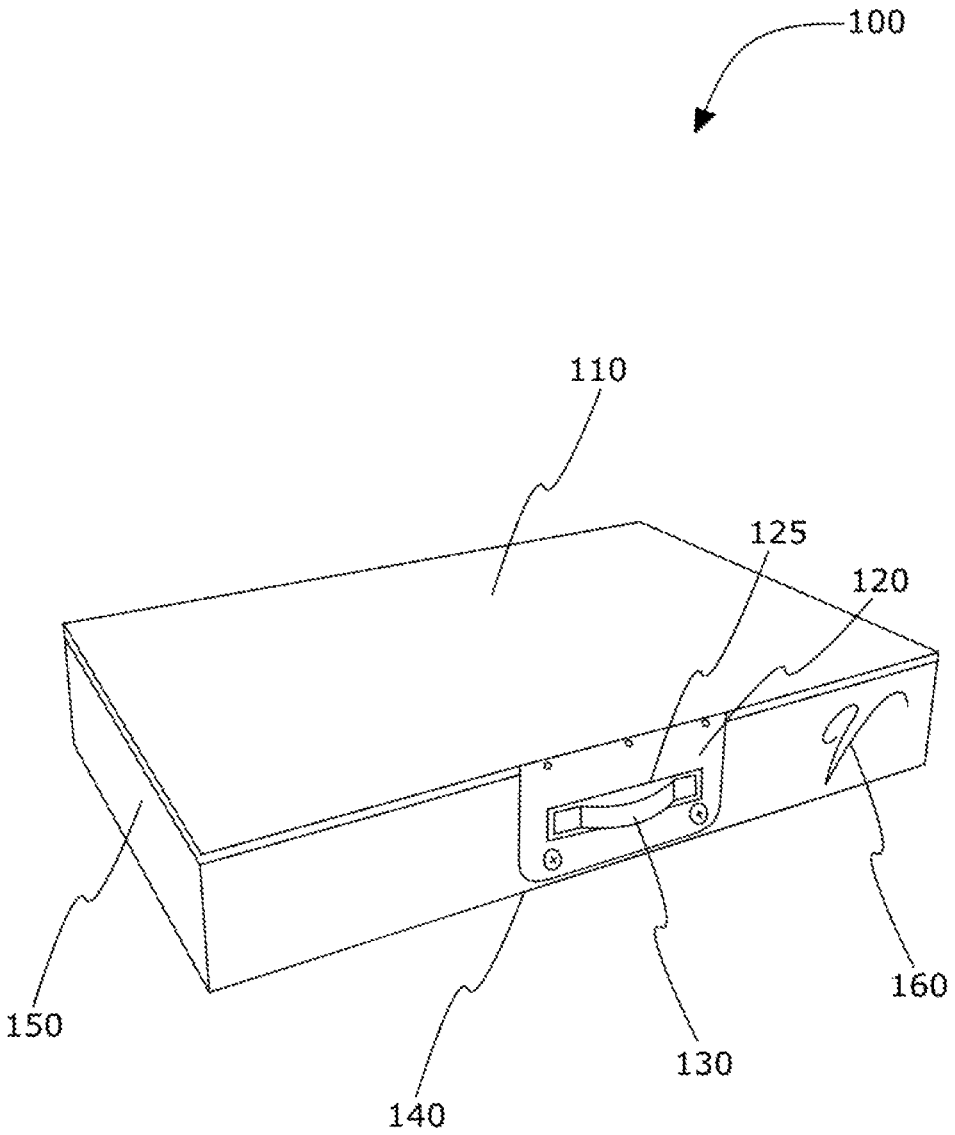
FIG. 1 is an illustration of an exemplary storage container device in a closed position that may be conveniently transported to any area for use, in accordance with an embodiment of the present invention.

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel.

Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of. or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

The present invention will now be described in detail with reference to embodiments thereof as illustrated in the accompanying drawings.

FIG. 1 is an illustration of an exemplary storage container or case device 100, wherein the storage container device may allow convenient access and proper application of cosmetics from practically any location (e.g. portable), whereby satisfying needs that are created due to the environments of traditional cosmetics application, in accordance with an embodiment of the present invention. In the present embodiment shown, the storage container device 100 may include a cosmetics vanity that includes a compartmentalized storage area for categorization and storage of cosmetic items. The portable storage container device 100 may further include a primary lid portion 110, a base/case section 150, a flap implement 120 having an aperture portion 125 and a securing fastener with flap buttons 140, and a handle implement 130 to aid in the portability of the device. The handle implement 130 is disposed on the same sidewall as the flap implement 120 and extends through an aperture portion 125 of the flap implement 120. The flap buttons 140 may include a female piece of the securing fastener 140 connected to the flap implement 120. The base/case section 150 may be used to store cosmetics and/or items that may be conveniently transported to any area for use. The storage container device 100 is a portable storage container device that may be made of various materials, including durable plastics such as but not limited to polypropylene (PP) and lightweight metals such as but not limited to aluminum alloy. An exterior of the entire storage container 100 may be decorated with, but not limited to, an attractive design, pattern and/or logo 160. The storage container device 100 when fully closed, measures approximately twenty-one inches in length by fourteen inches in width by three inches in depth (21"×14"×3"). The lid portion of the storage compartment may measure approximately one-half of an inch (½") in depth, while the remaining base section measures approximately two and one-half inches in depth (2½"). In other embodiments, the lid portion and the base section may comprise various depths, lengths, widths, sizes and shapes.

In some embodiments, the flap implement 120 may be an overlapping flap implement that extends from the center-width of the lid portion, and includes securing fasteners. The overlapping flap implement 120 corresponds in alignment to accepting a fastener on the center-width of a front wall of the base section 150. The overlapping flap implement 120 and fastener secure the lid of the storage container device when it is closed. An edge perimeter of the lid portion and base section may be lined with gaskets made of polyvinyl chloride (PVC) rubber or other rubberized material. A storage bag, made of durable fabric and sealable by a drawstring, may host the entire storage container device 100 when not in use. The storage container device 100 may be of various sizes and shapes and may be made from a combination of materials including, but not limited to, polyethylene terephthalate (PET), high-density polyethylene (HDPE), polyvinyl chloride (PVC), acrylonitrile butadiene styrene (ABS), and various woods.

Figure 2:
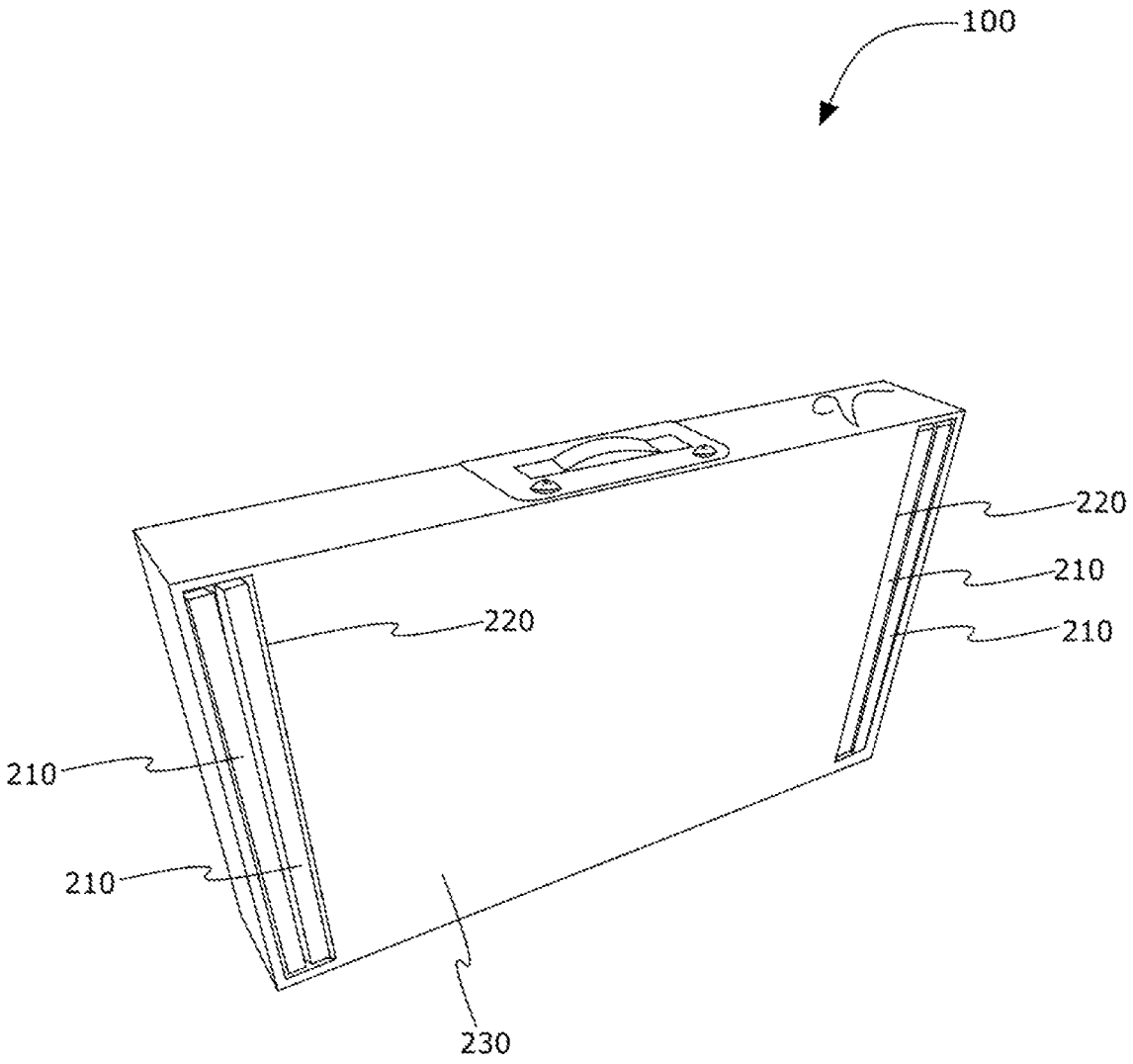
FIG. 2 is an illustration of an exemplary storage container device including chambers for concealing support legs, in accordance with an embodiment of the present invention.

FIG. 2 is an illustration of an exemplary storage container or case device 100, in accordance with an embodiment of the present invention. In the present embodiment shown, on the lower-exterior plane or bottom portion 230 of the base/case section 150 are two (2) open compartment/chamber sections 220, one (1) at each length-end, each measuring approximately fourteen inches in length by on inch in width (14"×1"). Two support leg implements may be concealed with each of the two compartment/chamber sections 220. The two support leg implements 210 may retract into each compartment/chamber section 220 for storage. The retracted leg implements 210 may be flush against the outer surface of the bottom portion 230. The concealable and retractable support leg implements 210 are accessible from the two open compartment sections 220 on the lower plane of the storage container device 100. The retractable support legs 210 may be made of various lengths, sizes and shapes. Contained within each compartment/chamber section 220 may comprise of two (2) retracted leg implements 210, totaling four (4) for the device. Each leg implement 210 may be telescoping. The leg implements 210 are in engagement within the chamber section 220 by screw or peg 920 (FIG. 9) within L-shaped columns 930 (FIG. 9), and which allow the leg implements 210 to extend parallel as well as perpendicularly from the base portion. The screw or peg 920 (FIG. 9) is secured within the L-shaped columns 930 (FIG. 9), which holds the leg implements to the device but allows the leg implements to move along that open L-shaped column. This allows the leg implements to be pulled down from the chamber section 220, and then if desired the leg implements can be folded outward. The down and then outward motion of the leg implements increases the height of the vanity. The leg implements 210 may feature strategically-placed notches that may releasably-engage with the storage container device 100 for secure placement when the leg implements 210 are minimally extended. That is, the leg implements 210 are still parallel to the case section and only raise the storage container by a couple inches. The leg implements 210 may feature telescoping sections adjustable by spring-loaded tabs and apertures. The bottom of each leg implement may include a cap made of a frictional material such as a textured rubber. These caps help support the device upon a surface. However, the caps also make frictional contact with the sidewalls of the chamber section 220 to hold the leg implements in place when the leg implements are stored in the chamber section 220.

Figure 3:
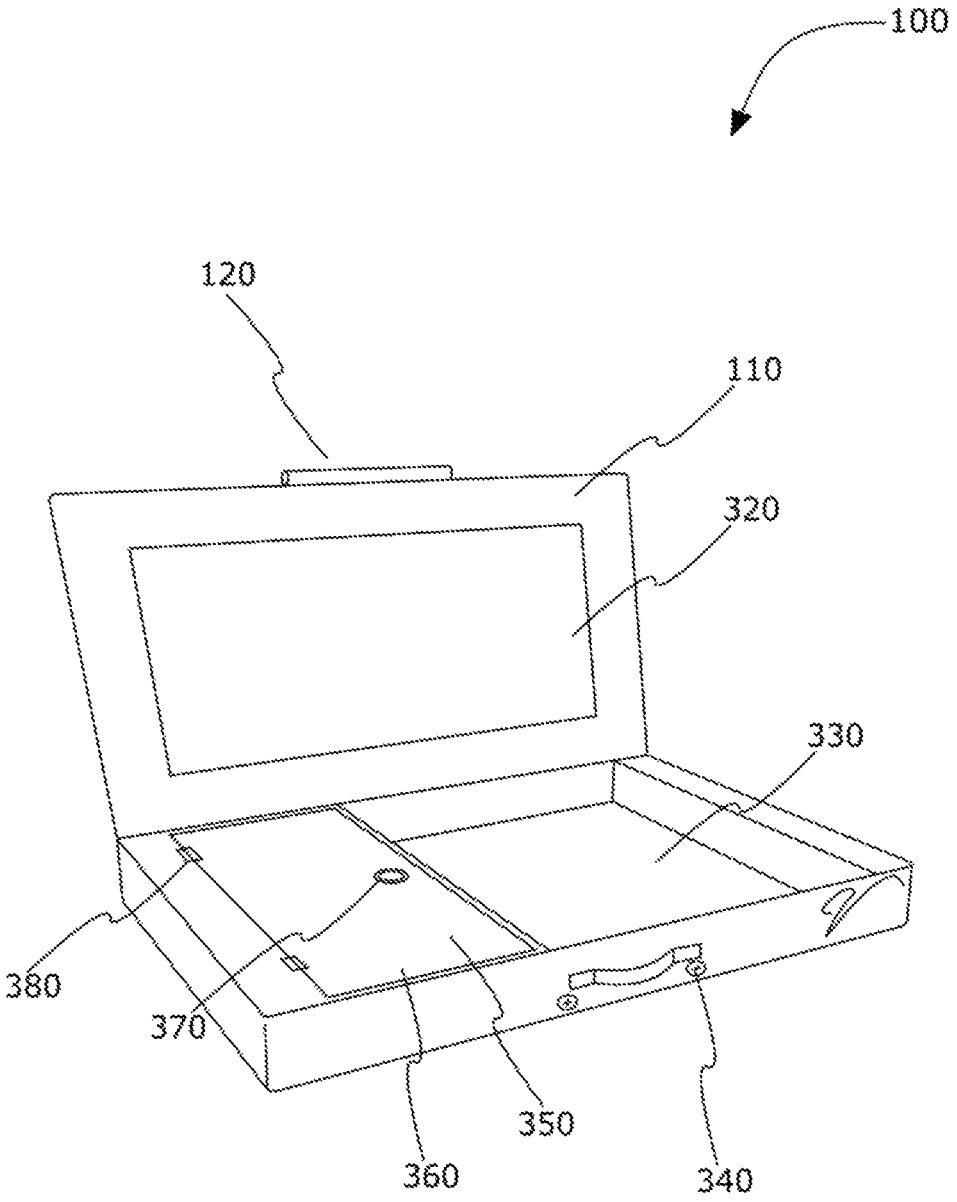
FIG. 3 is an illustration of an exemplary storage container device including a vanity mirror in engagement with an interior of a lid, in accordance with an embodiment of the present invention.

FIG. 3 is an illustration of an exemplary storage container device 100, in accordance with an embodiment of the present invention. In the present embodiment shown, the interior area of the base portion includes one (1) lidded compartment, and which occupies approximately seven inches (7") of the total twenty-one-inch (21") length. The interior plane of the primary lid portion 110 includes a mirror appliance 320, measuring approximately twenty inches in length by twelve inches in height (20"×12"). The exterior area includes the flap implement 120 folded back over the primary lid portion 110 and male pieces 340 of the securing fastener 140. A large storage compartment 330 and smaller storage compartment 350 may store cosmetics and/or items that may be conveniently transported to any area for use. The base section 150 may comprise a small storage compartment 350 having a compartment lid 360 (in a closed position) attached by hinges 380 in engagement with a wall portion 410 (FIG. 4) of the support leg storing chamber 220. The small storage compartment lid 360 may include a lid handle 370 that may aid in opening the compartment lid 360. In alternative embodiments, the storage compartment may feature various number of storage compartments, which can be of various sizes and shapes, and which may or may not feature lids. The storage compartment may feature various storage and/or storage enhancement features, such as but not limited to pouches, cubicles, and brackets. In additional embodiments, the mirror may include lighting. The lighting may be of various formats, such as but not limited light-emitting diodes (LEDs), and the lighting may be powered by battery or power cord.

Figure 4:
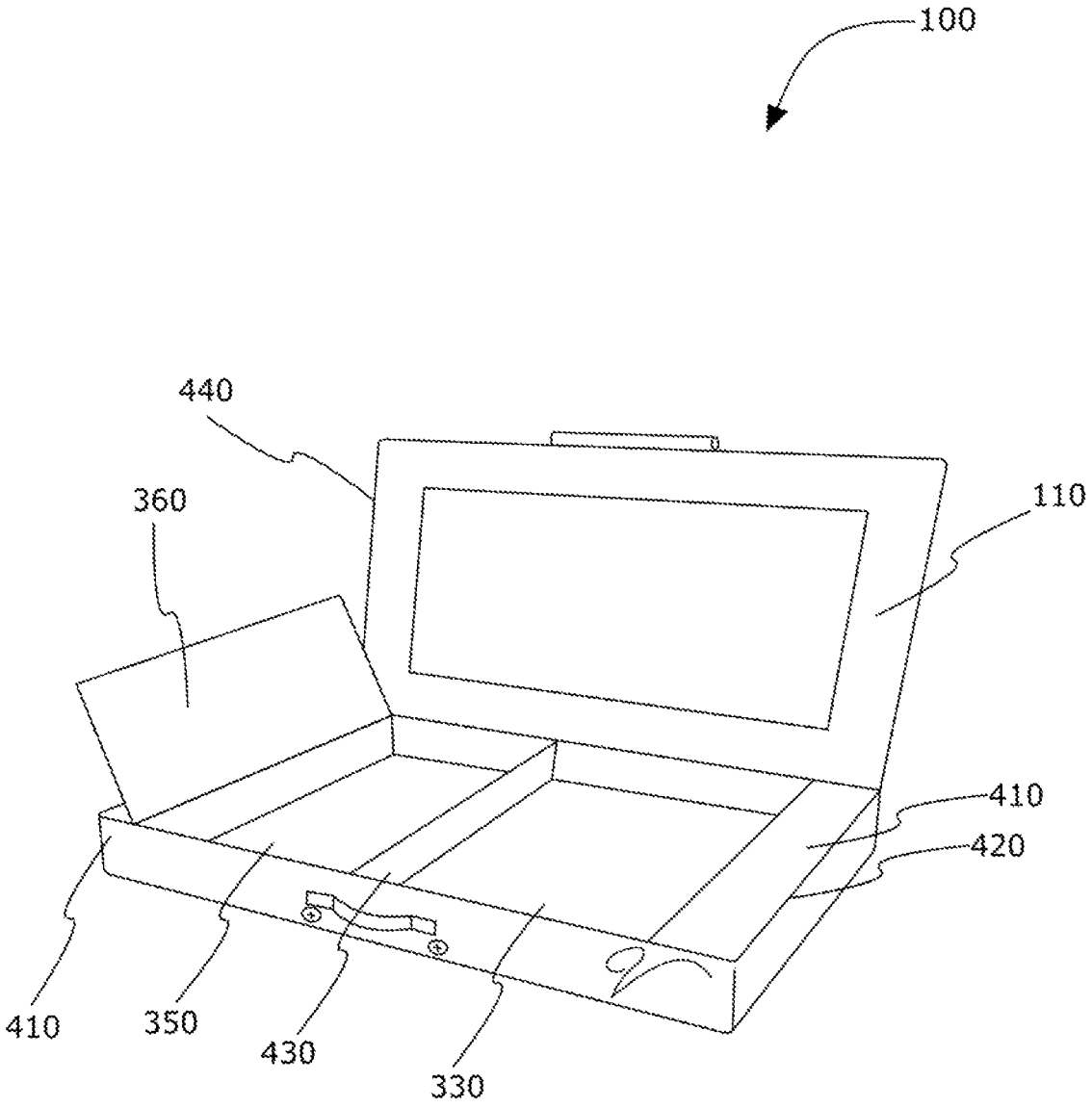
FIG. 4 is an illustration of an exemplary storage container device including storage compartments within its interior, in accordance with an embodiment of the present invention.

FIG. 4 is an illustration of an exemplary storage container device 100, in accordance with an embodiment of the present invention. In the present embodiment, the compartment lid 360 is in an open position, a wall portion 410 of support leg storing chamber section 220 and an interior dividing wall 430 is shown. The wall portion 410 is configured to cover the support leg implements 210 retracted within said chamber section 220. A sealing gasket may be disposed about a contact perimeter of the primary lid portion 110 and the case section 150. It is contemplated that the gasket may be made of a multiplicity of suitable materials, such as, but not limited to, natural and synthetic rubbers, neoprene, polyvinyl chloride (PVC), ethylene propylene diene (EPDM), etc. The primary lid sealing gasket 440 lines an interior edge perimeter of the primary lid portion 110 that may make contact with the contact perimeters of the base section 150 while the base section sealing gasket 420 lines an interior edge perimeter of the case section 150 that makes contact with the primary lid sealing gasket 440 lining the interior edge perimeter of the primary lid portion 110. When the primary lid portion 110 is shut, the sealing gaskets mesh together to form a generally tight seal. This may prevent moisture, germs, dirt and other undesirable elements from getting in the vanity and making damaging-contact with the contents of the device such as, but not limited to, cosmetic items. The interior surface may be padded or cushioned to generally prevent the contents from contacting hard surfaces.

Figure 5:
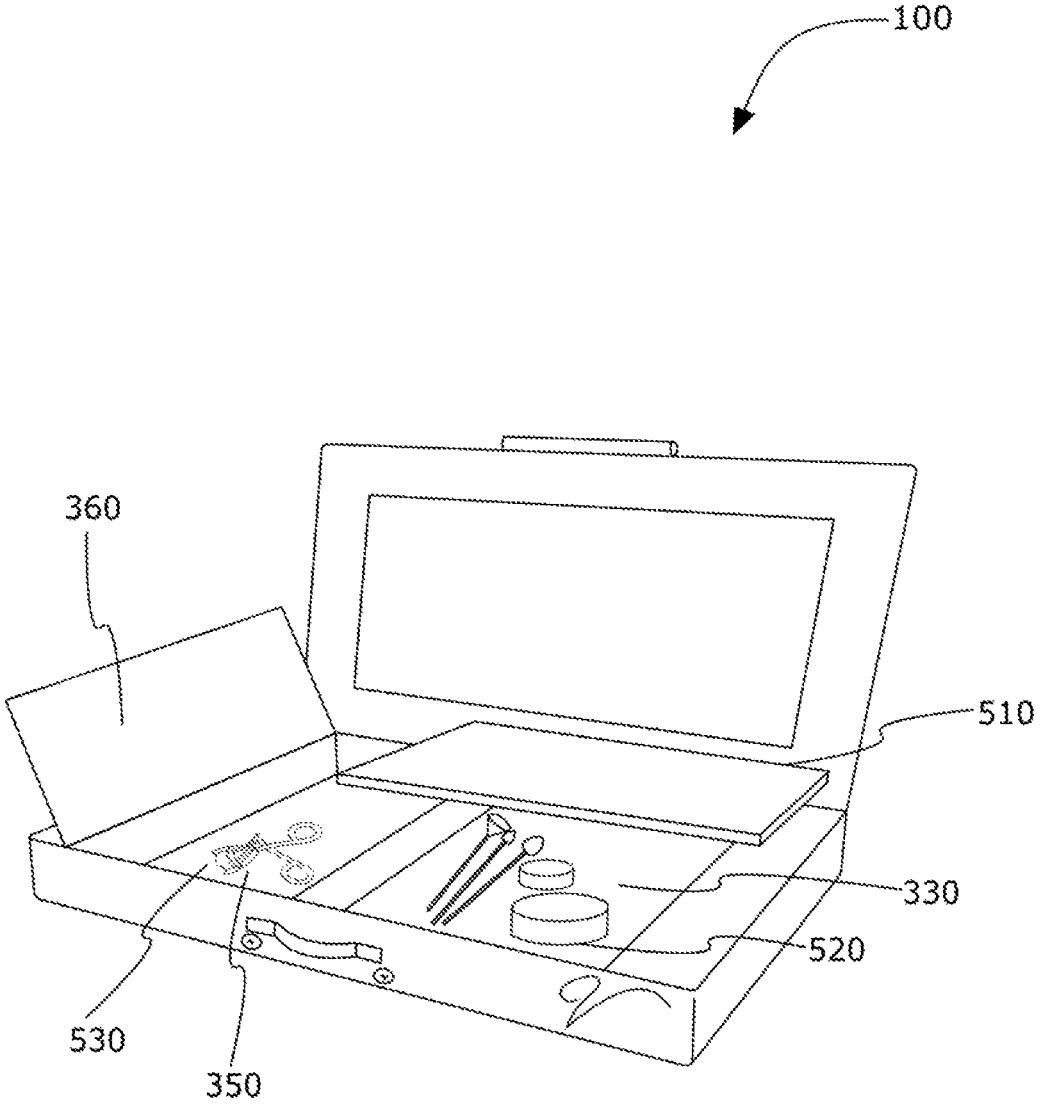
FIG. 5 is an illustration of an exemplary storage container device containing cosmetics and other items, in accordance with an embodiment of the present invention.

FIG. 5 is an illustration of an exemplary storage container device 100, in accordance with an embodiment of the present invention. In the present embodiment shown, the large storage compartment 330 may include a protective padding 510 and may store cosmetics and/or items 520. The protective padding 510 is operable for placement between the mirror and case. The protective padding 510 is configured to prevent stored cosmetic items from making contact with the mirror during transport and/or repositioning of device height. The protective padding 510 may be made of polyvinyl chloride (PVC) foam for application against the mirror when container is closed. The smaller storage compartment 350 may store items 530 that may be conveniently transported to any location for use. The smaller storage compartment 350 has a lid 360. The interior surface may be slightly padded or cushioned. A foam sheet contained within a soft lining of fabric material may substantially provide padding and/or cushioning for the interior surface of the device. Various different types of materials may be used to make the foam sheet including, but not limited to, polyvinyl chloride (PVC) foam, Polyurethane foam, high-density foam, latex rubber foam, rubber padding.

Figure 6:
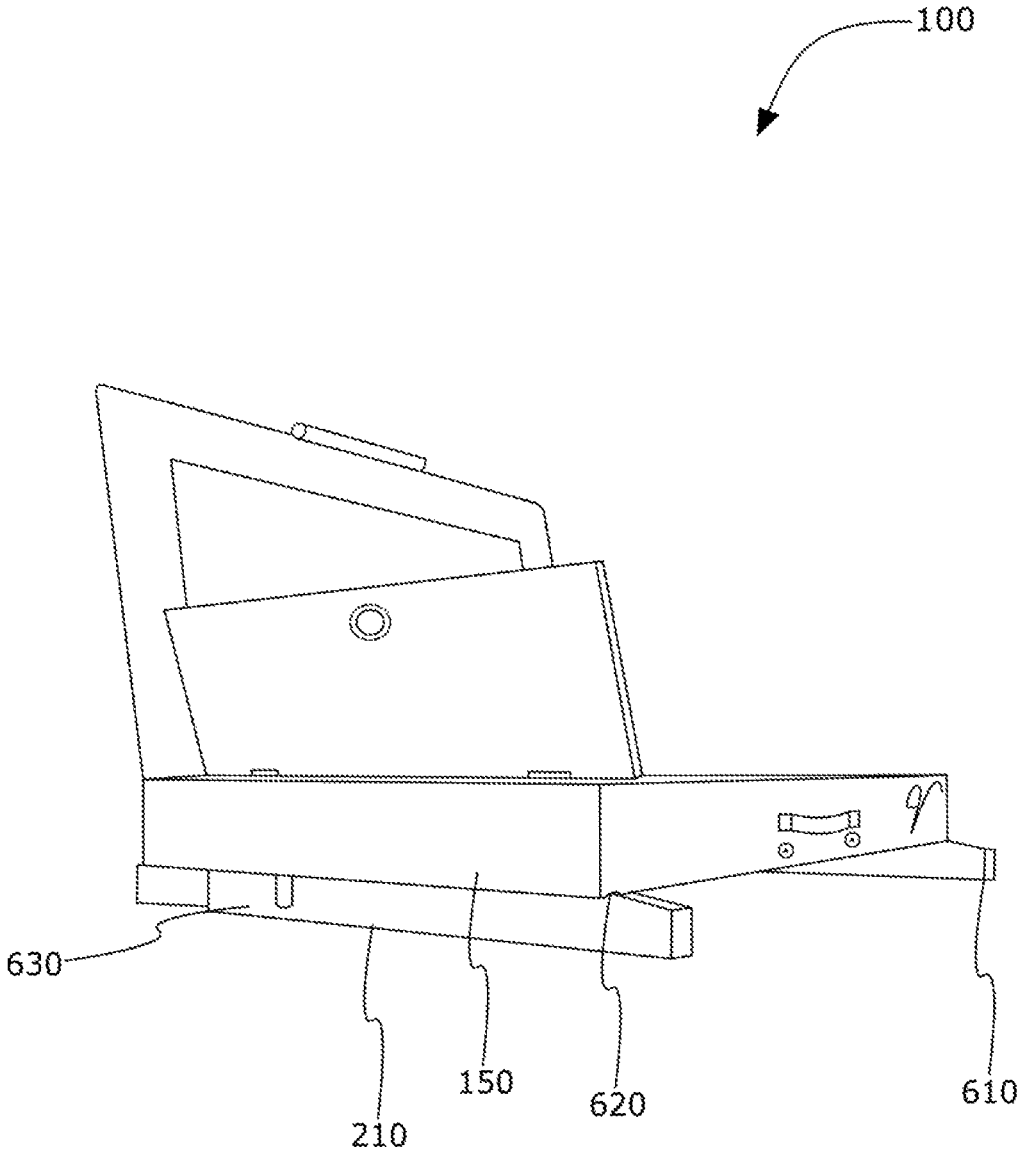
FIG. 6 is an illustration of an exemplary storage container device, wherein the leg implements are extended partially in parallel with a base portion, in accordance with an embodiment of the present invention.
Figure 8:
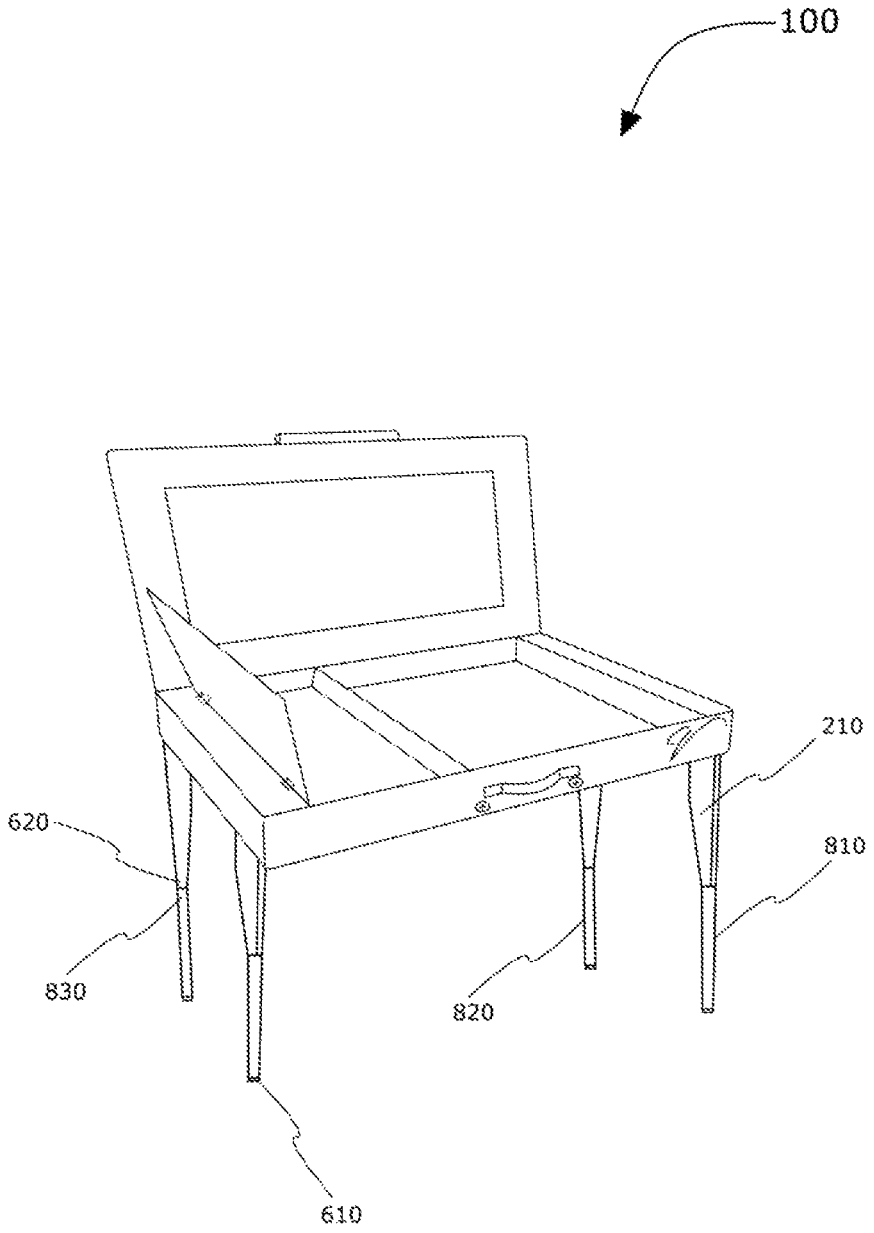
FIG. 8 is an illustration of an exemplary storage container device including telescoping support legs configured to enable to device to be raised to a desired and convenient height, in accordance with an embodiment of the present invention.

FIG. 6 is an illustration of an exemplary storage container device 100, in accordance with an embodiment of the present invention. In the present embodiment shown, the base section 150 rests in the notch portion 620 within each leg implement 210. The mating of the notch portion 620 with the base section 150 secures the based section 150 in a stable position during use. Each leg implement 210 includes an L-shaped open column near their widest ends. A portion of the L-shaped open column 630 and a screw or peg 930 (FIG. 9) is fastened within the L-shaped open column 630 and may allow the leg implements 210 to move along the open L-shaped column. The L-shaped open column 630 is operable for allowing said leg implement 210 to extend out of said chamber section 220 and/or retract into said chamber section 220. Leg implement caps 610 line an end portion of each height-adjustable or telescoping leg implement 820 (FIG. 8). Each leg implement cap 610 may be made of frictional material including but not limited to texturized rubber, acrylonitrile-butadiene rubber (NBR), hydrogenated acrylonitrile-butadiene rubber (HNBR), ethylene propylene diene rubber (EPDM), and polyvinyl chloride (PVC).

Figure 7:
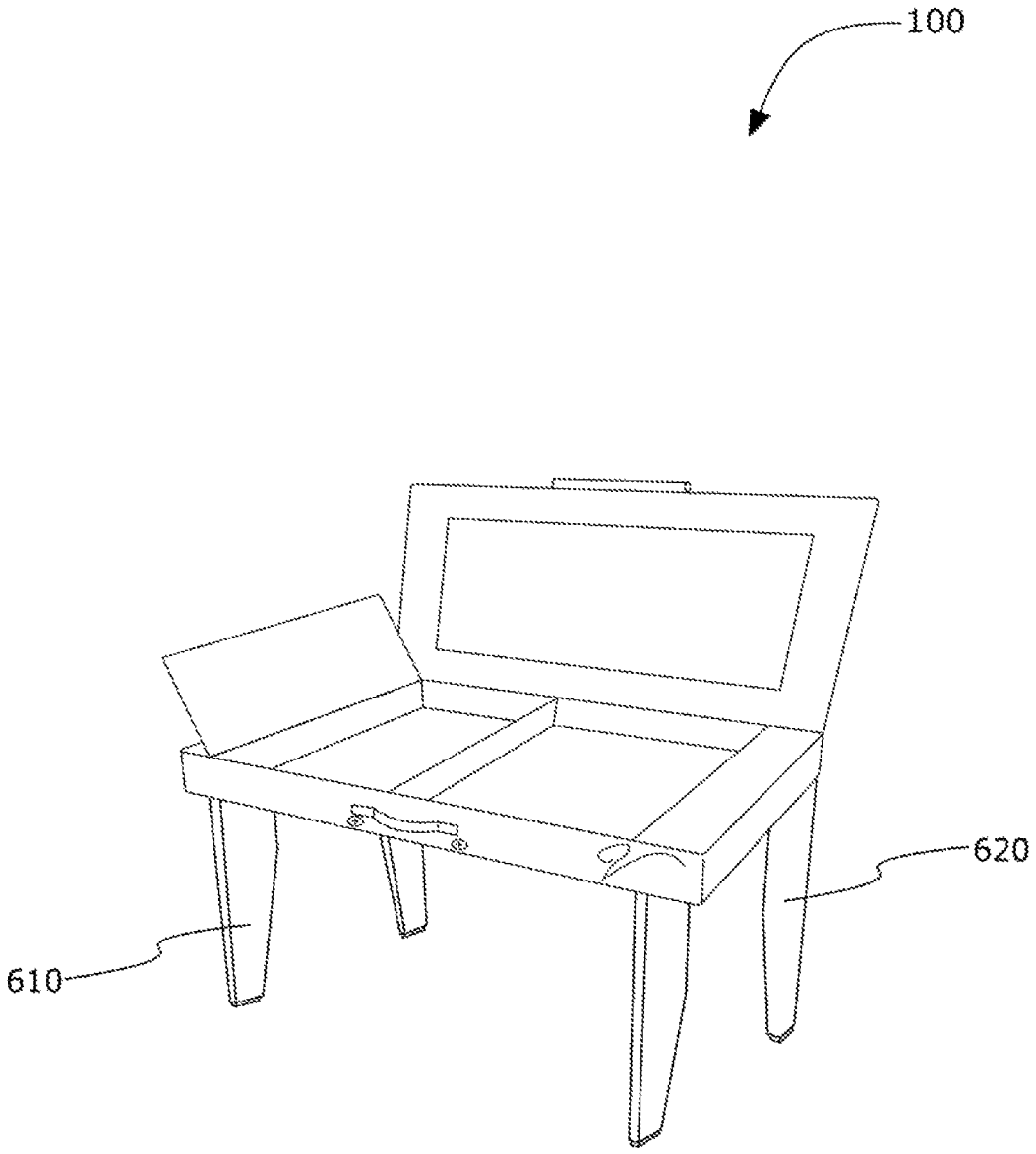
FIG. 7 is an illustration of an exemplary storage container device including retractable and height-adjustable support legs, in accordance with an embodiment of the present invention, in accordance with an embodiment of the present invention.

FIG. 7 is an illustration of an exemplary storage container device 100, in accordance with an embodiment of the present invention. In the present embodiment shown, the support leg implements 210 are drawn out, which extends the storage container device 100 to mid-height. Frictional leg implement caps 610 are configured to stabilize the device on a surface and at the same token, provide the friction that holds the support leg implements 210 within the storage chambers 220.

FIG. 8 is an illustration of an exemplary storage container device 100, in accordance with an embodiment of the present invention. In the present embodiment shown, each support leg implement 210 may comprise of a plastic portion and a notch portion 620 near the end of a plastic portion for concealing a height-adjustable or telescoping leg implement 820. Within each plastic portion of the support leg implement 210 is the height-adjustable leg implement 820 that can be extended from the plastic portions. The extendable or telescoping leg implements 820 may be made of lightweight aluminum and includes aperture/hole portions 810 along their length. Spring-loaded tabs 830 may fit within the aperture/hole portions 810 to secure the height of the telescoping leg implements 820. This allows the height of the device to be further adjusted. The increase in the height of the storage container device and the leg implement caps keep the storage container device in stable position while being used. In additional embodiments, the support leg implements 210 are drawn out and the telescoping leg implements 820 of the support leg implement 210 are extended out which extends the storage container device 100 to full-height. The telescoping leg implements 820 may be made of, but not limited to lightweight aluminum, polyvinyl chloride (PVC), high-density polyethylene (HDPE) and various woods. The frictional leg implement caps 610 are in engagement with said telescoping leg implements 820 and configured to stabilize the device and at the same token, provide the friction that holds the support leg implements 210 within the storage chambers 220.

When the storage container device 100 is in need of use, in a method of using the device and in accordance with an embodiment of the present invention, the user may withdraw the device from its storage bag, and if desired extend its legs. After opening the lid and accessing the desired contents, the user may then apply cosmetics, using the included mirror to ensure proper application. When the device is no longer needed, the storage container device 100 may be closed, and may remain in its placement for decorative enhancement of that environment, or may be returned to the storage bag.

Figure 9:
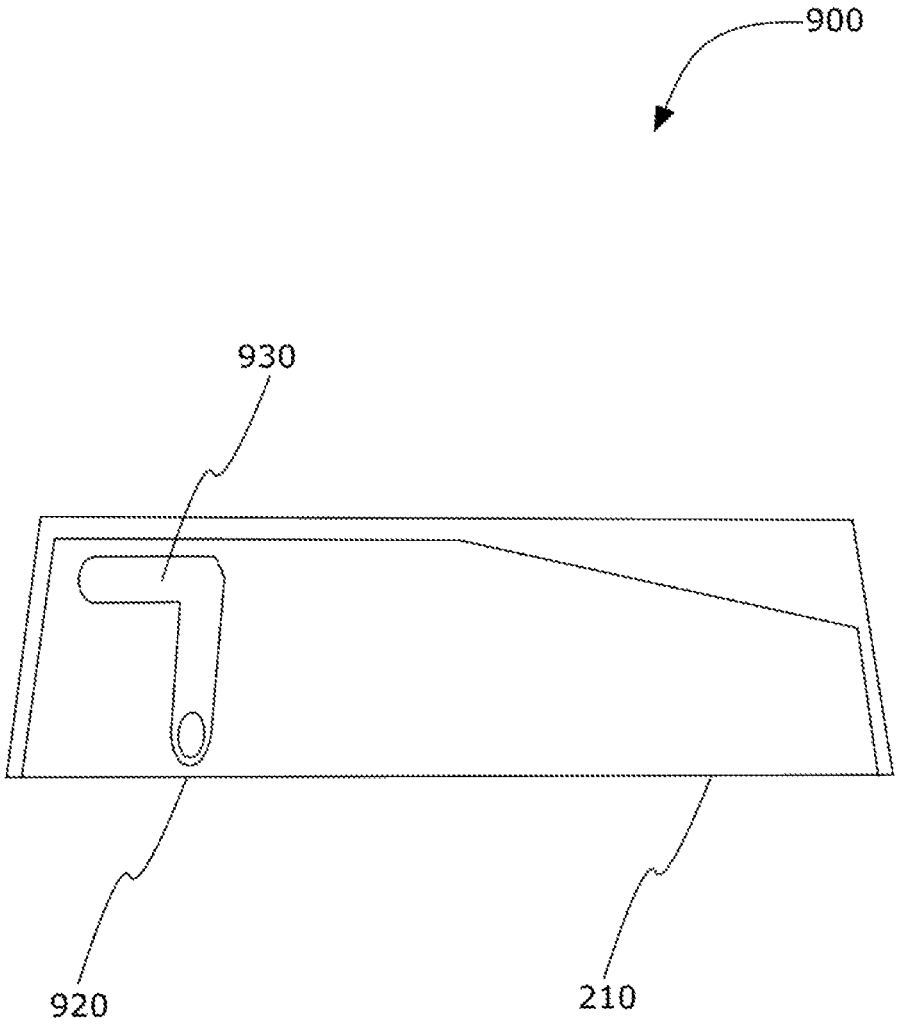
FIG. 9 is an illustration of an exemplary storage container device, in which the support leg is stored within the chamber, in accordance with an embodiment of the present invention; and Unless otherwise indicated illustrations in the figures are not necessarily drawn to scale.

FIG. 9 is an illustration of an exemplary support leg implement 210 stored within the chamber section 220, in accordance with an embodiment of the present invention. In the present embodiment shown, the support leg implement 210 is retracted within the chamber section 220 for storage. The support leg implements 210 may be in engagement within the chambers by screw or peg 930 within L-shaped columns 930, and which allow the support leg implements 210 to extend parallel too as well as perpendicularly from the base portion.

In alternative embodiments, the legs of the storage container device 100 may be of various lengths. The legs may or may not be made in telescoping formats. The legs may or may not feature friction caps for securing its placement when in use. The storage container device 100 may include a various number of storage compartments, which can be of various sizes and shapes, and which may or may not feature lids. The interior may include various storage and/or storage enhancement features, such as but not limited to pouches, cubicles, and brackets. The storage compartment(s) may be removable and/or replaceable. The padding material may be made of various materials of applicability, such as but not limited to polyethylene (PE) foam. The padding material may or may not be contained within a fabric lining, which can be produced of various materials. The padding material may be separate and fully removable, or may be attached by stitch to a lining of the interior, and which would allow it to be folded away from the interior without complete separation from the structure. The lining (e.g. gasket) between the contact perimeters of the lid segment and the base potion may be made of various applicable materials, such as but not limited to neoprene and polyvinyl chloride (PVC). The storage container device 100 may be decorated with various designs, patterns, logos and/or images, which may or may not be of registered trademark and/or copyright status.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post MA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing the storage container device according to the present invention will be apparent to those skilled in the art. Various aspects of the invention have been described above by way of illustration, and the specific embodiments disclosed are not intended to limit the invention to the particular forms disclosed. The particular implementation of the storage container device 100 may vary depending upon the particular context or application. By way of example, and not limitation, the storage container device 100 described in the foregoing were principally directed to storage and application of cosmetic implementations; however, similar techniques may instead be applied to make-up kits, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

a base section, wherein said base section is configured to be operable for storing or transporting of cosmetic items;

a compartmentalized storage area disposed within an inner portion of said base section, in which said compartmentalized storage area comprises at least one large storage area and at least one small storage area;

a primary lid portion, wherein said primary lid portion is configured to provide a cover for said base section;

a mirror appliance disposed on an interior surface of said primary lid portion;

a cushioned interior surface;

a protective pad that is configured to prevent the stored cosmetic items from making contact with said mirror appliance during transport;

a support leg implement, in which said support leg implement comprises a retractable support leg implement;

an open chamber section, in which said open chamber section comprises at least two open chamber sections, each of said at least two open chamber sections being disposed on each side of a bottom portion of said base section, wherein each of said least two open chamber sections is configured to house at least two retractable support leg implements;

an L-shaped open column disposed in said support leg implement, wherein said L-shaped open column is configured to allow said support leg implement to at least one of, extend out of said open chamber section and retract into said open chamber section and further configured to be operable for supporting said support leg implement to at least one of, extend parallel and extend perpendicularly from said base section, a peg implement, said peg implement is into engagement with said L-shaped open column, wherein said peg implement is configured to be operable for allowing said support leg implement to move along said L-shaped open column;

and a notch portion, said notch portion is disposed in a lower portion of said support leg implement wherein said notch portion is configured to secure said base section in a stable position when said support leg implement extends out of said open chamber section and wherein said notch portion is configured to secure said base section within said notch portion when said support leg implement is pulled down from said chamber section, parallel to a bottom portion of said base section.

2. The device of claim 1, further comprising at least a height-adjustable support leg implement that is in engagement with said support leg implement.

3. The device of claim 2, in which said support leg implement further comprises at least four support leg implements and said height-adjustable support leg implement comprises at least four height-adjustable support leg implements.

4. The device of claim 3, wherein each of said at least two open chamber sections comprises a wall portion disposed on an inner portion of said base section, wherein said wall portion is configured to cover said support leg implement retracted within said chamber section.

5. The device of claim 2, in which said height-adjustable support leg implement comprises a plurality of apertures.

6. The device of claim 5, in which a spring-loaded tab fits within each of said plurality of apertures, wherein said spring-loaded tab is configured to allow a height of the support leg implement to be adjusted.

7. The device of claim 6, in which a bottom of said height-adjustable support leg implement comprises a cap implement made of a frictional material, wherein said cap implement is configured to support the device upon a surface and make frictional contact with a sidewall of said chamber section to hold said support leg implement in place when said support leg implement is stored in said chamber section.

8. The device of claim 1, further comprising a primary lid sealing gasket configured to line an interior edge perimeter of said primary lid portion.

9. The device of claim 8, further comprising a base section sealing gasket configured to line an interior edge perimeter of said base section that, wherein when the primary lid portion is shut, said base section sealing gasket is further configured to make contact with said primary lid sealing gasket operable for forming a tight seal to prevent moisture, germ, dirt or other undesirable elements from getting in the device and making damaging-contact with a cosmetic content.

10. The device of claim 1, wherein each support leg implement includes an L-shaped open column proximate their widest ends.

11. The device of claim 1, further comprising a flap implement, in which said flap implement comprises an aperture portion.

12. The device of claim 11, in which said flap implement further comprises a flap button of a securing fastener, wherein said flap button includes a female piece of said securing fastener.

13. The device of claim 12, further comprising a male piece of said securing fastener disposed on proximate center of a front wall portion of said base section.

14. The device of claim 13, further comprising a handle implement, wherein said handle implement is configured to aid in a portability of said device.

15. The device of claim 14, in which said flap implement further comprises an aperture portion, wherein said flap aperture portion is operable for allowing said handle implement to extend out of said flap implement.

16. The device of claim 1, further comprising a small compartment lid attached to hinges that are in engagement with a wall portion of said support leg storing chamber.

* * * * *